United States Patent [19]

Lamboley

[11] 3,948,199

[45] Apr. 6, 1976

[54] TUBULAR METAL MAST FOR THE RIGGING OF A SAILING BOAT

[76] Inventor: Gilbert Lamboley, Route de Saint-Romain, 69450 Saint-Cyr-Au-Mont-D'or (Rhone), France

[22] Filed: May 10, 1974

[21] Appl. No.: 468,889

[30] Foreign Application Priority Data

May 10, 1973 France ..... 73.16879

[52] U.S. Cl. ..... 114/90

[51] Int. Cl.[2] ..... B63B 15/00

[58] Field of Search ..... 114/39, 90, 89, 102

[56] References Cited

UNITED STATES PATENTS

| | | | |
|---|---|---|---|
| 3,418,958 | 12/1968 | Wyatt | 114/89 |
| 3,483,840 | 12/1969 | Prölss | 114/39 |
| 3,795,215 | 3/1974 | Butler | 114/90 |

FOREIGN PATENTS OR APPLICATIONS

| | | | |
|---|---|---|---|
| 1,444,722 | 4/1965 | France | 114/90 |
| 270,890 | 1/1963 | Australia | 114/90 |

*Primary Examiner*—Trygve M. Blix
*Assistant Examiner*—Sherman D. Basinger
*Attorney, Agent, or Firm*—Diller, Brown, Ramik & Wight

[57] ABSTRACT

The invention relates generally to masts for the rigging of sailing boats, such as for example centerboard boats of the "FINN" series, and is directed to the problem of increasing the elasticity of known masts of wood or tubular metal. A mast according to the invention is provided with a longitudinal slot, the lips of which may be brought to face each other and are fixed together in places in a non-continuous manner. By this means the mast is given a substantial capacity for elastic torsion, resulting in improvement in its performance.

9 Claims, 15 Drawing Figures

FIG. 1
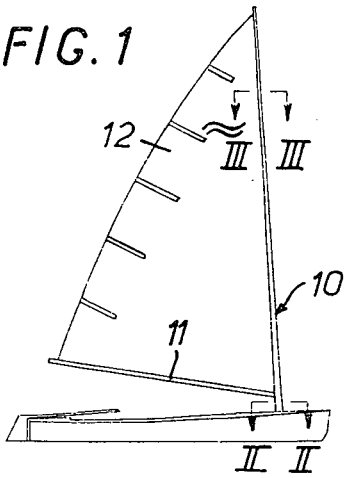
FIG. 4
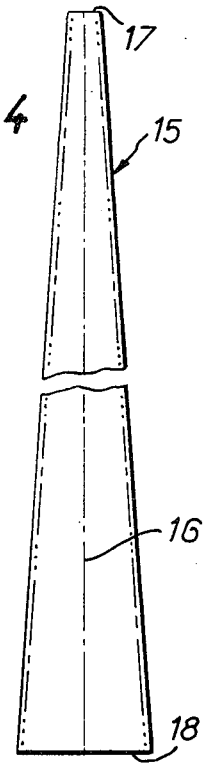
FIG. 2
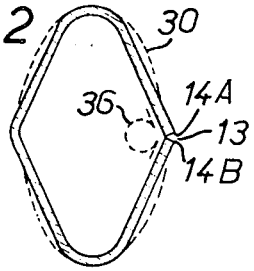
FIG. 3
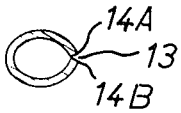
FIG.5A
FIG.6 FIG.7 FIG.8
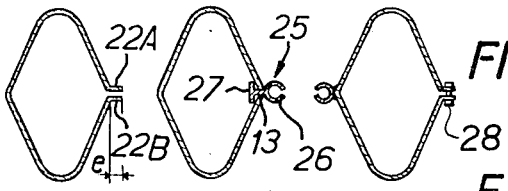
FIG.5B
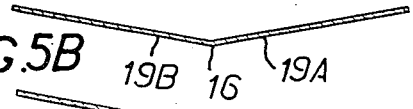
FIG.5C
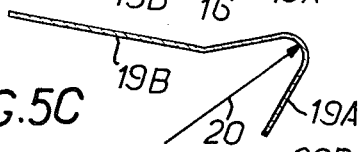
FIG. 9
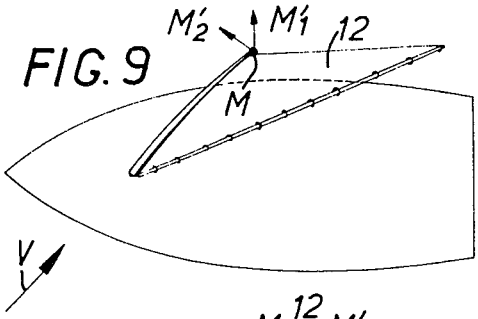
FIG.5D
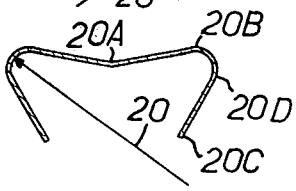
FIG.5E
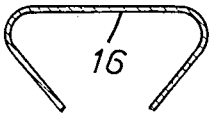
FIG.10
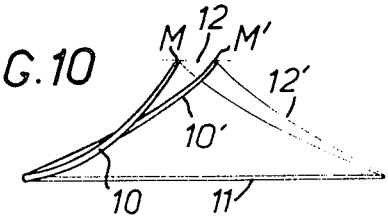
FIG.5F
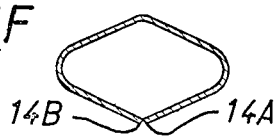

TUBULAR METAL MAST FOR THE RIGGING OF A SAILING BOAT

The present invention relates in a general manner to masts intended for the rigging of sailing boats, such as for example center-board boats of the "FINN" series.

As is well known, the mast of a sailing boat on open water works constantly under the force which is continuously applied to the sails which it carries, both by reason of the roughness of the water and due to variations of the wind.

When the force on the sails increases, the mast bends and stores-up energy.

When the force on the sails diminishes, the mast straightens and restores in the form of propulsive energy at least part of the energy previously stored.

If the mast had a perfectly elastic behaviour, this restoration of energy would be complete.

In practice, since the behaviour of the mast is not elastic, a part of this energy is lost.

This is especially the case with wooden masts, since as wood is a material having a visco-elastic behavior, a large part of the energy stored by such a mast becomes dissipated in internal friction of the fibres of which it is constituted, and is therefore lost.

On the other hand, as metals are substances the behavior of which obeys to a very large extent the ideal laws of elasticity, a metal mast advantageously restores an appreciable part, or even practically the whole of the energy which it has previously stored by elastic deformation.

This is one of the reasons why, at the present time, masts of metal and especially of aluminum are preferred to wooden masts for the rigging of sailing boats, and in particular for boats intended for competition tests.

The metal masts known at the present time are of tubular section and are generally manufactured by extrusion.

In consequence, it is difficult to vary their section and therefore their inertia, whereas it is desirable for example that the head of such a mast should be finer than its base in order that this mast may have greater bending capacity, and also in order that its top portion may be lighter.

However, in order to vary the section of such a mast, various solutions have been proposed.

According to a first solution, a triangular segment of the mast, of variable length, is cut out over a certain height of the mast and the lips thus formed longitudinally in the mast are then brought together and welded to each other.

According to a second solution, a more or less pronounced flattening of an initially circular tube is effected locally over a part of the height of this tube.

According to a third solution, which is furthermore much more costly, the extrusion of such a mast is effected by means of a variable section die.

In all cases, the tubular metal masts known at the present time have in section a closed profile over the whole of their height, that is to say all their transverse sections are circularly or annularly continuous.

The result is that such masts have very great torsional rigidity and that they can hardly be deformed except under the effect of bending moments, very much more than under the effect of torsion couples.

The present invention has especially for its object a mast having on the contrary a non-negligible torsion capacity.

It has also for its object a method of production of such a mast, which is furthermore capable of being applied to the production of other types of masts.

The tubular metal mast according to the invention, for the rigging of a sailing boat, is characterized in that over at least part of its height, its transverse section has a discontinuity, and for this reason constitutes an open profile.

In practice, a mast of this kind is provided longitudinally with a slot, the lips of which, possibly but not necessarily facing each other, are not continuously joined together.

The result is that a mast of this kind has low torsional rigidity.

This arrangement has numerous advantages.

In the first place, the sailing boat equipped with such a mast, sailing "close" that is to say against the wind, the possible oscillations of the apparent wind applied to this sailing boat displace the head of the mast forward by torsion, and in consequence, the inclination towards the front of the resultant of the action of the wind on the sails carried by this mast then becomes advantageously accentuated.

In addition, the torsional movements which can be effected by the mast according to the invention make it possible with advantage to give the sails which it carries an attractive form for the propulsion of the boat on which it is fitted.

In fact, as the mast according to the invention is capable of a certain torsion, the sails which it carries are liable to be given a variable torsion movement which enables them to absorb with flexibility the possible accelerations of the wind, from which there results an increase in the propulsive force. During decelerations of the wind, the sails return towards the rear and again communicate an acceleration to the boat, the energy previously stored by the mast by torsion being thus freed in a particularly advantageous manner.

This advantage will be all the more appreciated if it is recalled that on the contrary the transverse bending movements of a mast are bad for the form of the sails which it carries.

In addition, and due to the fact that, as explained above, the torsion of the mast according to the invention leads to a forward movement of the sails which it carries, the phenomenon due to a possible list of the sailing boat is automatically opposed, and it is not necessary to act on the rudder for that purpose, which is advantageous since, as is well-known, such action on the rudder slows down the boat in an undesirable manner.

Furthermore, and due to its torsional capacity, the mast according to the invention is in itself adapted to the fact that the wind is stronger at the height of the head of a mast than at the level of the water.

With the mast according to the invention, it is possible for this reason to hold a better course than with masts which do not have bending capacity and to protect the upper portion of the sail which it carries from the action of the wind, which relieves the boat.

Finally, it has proved that the curvature of the sails carried by a mast capable of torsion according to the invention, perpendicular to the plane of the sails, is advantageously superior to that of the sails carried by a mast capable only of bending, and this results in a better capacity for propulsive action of the sails.

Preferably, and this is a second object of the invention, a mast of this kind is produced by shaping into a tube a sheet of metal which is initially flat and generally trapezoidal.

This manufacture by shaping results in itself in the existence of a slot over the entire height of the mast; the lips of this slot can be fixed to each other at spaced intervals, in positions where capacity for torsion is not necessary.

Such manufacture by shaping furthermore makes it possible advantageously to construct masts having a variable inertia over their entire height, and is therefore capable of being applied both to masts with a torsional capacity according to the invention and to masts which have essentially only a bending capacity of a conventional kind.

This manufacture by shaping finally makes it possible to utilize alloys having a higher limit of elasticity than those usually employed for manufacture by extrusion. In practice, it is possible according to the invention to utilize alloys having a limit of elasticity of at least 50 hectobars, such as is the case for example for the aluminum alloy known under the reference A Z 5 G U, in the state T6, whereas the alloys generally used for an extrusion have a limit of elasticity which only rarely exceeds 20 hectobars.

The objects of the invention, their characteristics and their advantages, will furthermore be brought out in the description which follows below, given by way of example, reference being made to the accompanying diagrammatic drawings, in which:

FIG. 1 is a view in elevation of a sailing boat fitted with a mast according to the invention;

FIGS. 2 and 3 are views to a larger scale in transverse section of this mast, respectively following the lines II—II and III—III of FIG. 1;

FIG. 4 is a plan view to a different scale of a metal sheet which has been used for the construction of a mast of this kind;

FIGS. 5A, 5B, 5C, 5D, 5E and 5F are views in transverse section of this sheet, illustrating the successive phases of the shaping process;

FIGS. 6, 7 and 8 are views similar to FIG. 2 and are each respectively concerned with an alternative form of construction;

FIG. 9 is a plan view of a sailing boat fitted with a mast according to the invention and illustrating certain advantages of this mast;

FIG. 10 is a diagrammatic view in plan of the sails carried by such a mast, together with those carried by a mast which essentially only has a capacity for bending.

FIG. 1 illustrates by way of example, the application of the invention to the rigging of a "FINN," of which the mast 10 is not braced as is well known.

Close to the base of this mast 10 there is fixed a yard or boom 11.

Following methods known in themselves and which will not be described below, the mast 10 and the boom 11 carry conjointly a substantially triangular sail 12.

According to the invention, the mast 10 is a tubular metal mast which, over at least a part of its height, has a section with a discontinuity or gap 13, a section of this kind constituting for this reason an open profile (see FIGS. 2 and 3).

In practice, this gap 13 is formed by a slot which runs longitudinally over at least part of the mast 10 and for example over the entire height of this mast.

In the example shown in FIGS. 2 and 3, the lips 14A, 14B of this slot are brought face to face with each other, but according to the invention they are not fixed to each other.

At the same time, the section of the mast 10 is different at its base (FIG. 2) than at its head (FIG. 3).

At the base of the mast (see FIG. 2), the section of this latter is relatively large and, in the example shown, has substantially the form of a lozenge, the small diagonal of which extends in the longitudinal plane of symmetry of the sailing boat.

At the head of the mast (see FIG. 3) the section of this latter in the example shown has substantially the shape of an oval, the major axis of which extends into the longitudinal plane of symmetry of the sailing boat.

According to the invention, a mast of this kind is formed by shaping a sheet of metal 15 which is initially flat and generally trapezoidal.

A plan view of this sheet is given in FIG. 4 and a cross-section in FIG. 5A.

As illustrated by FIGS. 5B, 5C, 5D, 5E and 5F, this sheet may first be given a shallow reverse fold about a line 16 substantially perpendicular to its bases 17 and 18 in the central zone of these latter.

This reverse fold may in fact prove necessary so as to permit subsequent shaping in the correct direction of the two panels 19A, 19B which are thereby produced.

The shaping of the panel 19A is illustrated in FIG. 5C, in which there has been shown diagrammatically at 20 the tool around which this shaping is effected.

Similarly, the shaping of the panel 19B is illustrated in FIG. 5D.

As shown in FIG. 5E, the reverse fold initially applied to the sheet is then eliminated, and then by folding the sheet round the line 16 defined above, the edges 14A, 14B of the panels 18A, 19B initially formed, are brought close together, as shown in FIG. 5F.

In practice, the flat portions defined respectively by the lines 20A, 20B and 20C–20D shown in FIG. 5 become smaller linearly from the base towards the head of the mast, and thus permit the transverse section of the mast to vary from the section shown in FIG. 2 to that shown in FIG. 3.

The degree of convergence of these lines ensures in fact the degree of variation of inertia of the two main inertias of the mast.

Preferably, and according to an arrangement which is not shown in the drawing, the section of the mast is reduced at its base by cutting out triangular tongues from the mast and bringing the lips thus formed to face each other.

As has already been explained, the mast according to the invention thus has a non-negligible capacity for torsion.

The result, as shown in FIG. 9, is that the oscillations of the apparent wind V applied to the sail 12 displace the head of the mast, not only from M to $M'_1$ by bending, but also from M to $M'_2$ by torsion.

As emphasized above, the inclination towards the front of the resultant of the action of the wind on the sail 12 is advantageously accentuated, and the portion of the mast gives the sail 12 a form advantageous to the propulsion.

The advantages of the mast according to the invention are furthermore better brought out in FIG. 10, in which the boom 11 is shown in plan view with on the one hand the mast 10 with capacity for torsion according to the invention, and the sail 12 which it carries, and on the other hand, a conventional mast 10' and the sail 12' carried by this latter, this conventional mast 10' being assumed to be only capable of working by bending.

FIG. 10 illustrates the deformation of these masts 10, 10' assumed to be working, the deformation of the mast 10' having been measured on an existing mast, and the deformation of the mast 10 having been drawn graphically from that preceding, assuming that the head of this mast is displaced by the same amount in the wind as the head of the mast 10', but only by torsion.

It is clearly apparent from FIG. 10 that with the mast according to the invention, the plane of the sail moves forward, with the advantages which result from this, as explained above.

In addition, and as can be seen from FIG. 10, the conventional mast 10' without torsion is projected almost along a straight line, this straight line being however curved at its extremity, the head of such a mast being abruptly thinned, following the present-day technique.

Nevertheless, the tangent to such a mast in projection, which must substantially have the direction of the apparent wind, only begins in fact to move away over a small part of the mast, which only makes it possible to take account to a small extent of the difference in speed of the wind between the base of the mast and the head of the mast.

On the other hand, the mast according to the invention, 10, is projected along a curve tangential to the boom 11, and the tangent of the projection of this mast varies advantageously in a continuous manner from the bottom to the top of the mast, which shows a better adaptation of this mast to the wind.

In accordance with the alternative form of construction shown in FIG. 6, the lips 14A, 14B of the slot 13 of the mast according to the invention are each edged with a small tongue 22A, 22B which extend parallel to each other, substantially along the longitudinal plane of symmetry of the sailing boat.

These small tongues 22A, 22B may be fixed to each other at selected spaced intervals, for example by welding, bolting or the like as is identified more specifically in FIG. 8 by the reference numeral 28. The general positions of these fasteners are shown in FIG. 4 along the opposite edges of the sheet 15. The more or less considerable spacing apart of these fixing points will permit a more or less considerable increase of the torsional rigidity over any portion of the mast. In this way, it is possible to ensure almost perfect control of the behavior of the mast.

The width *l* of these tongues may be constant over their whole length; this width may also be variable and adjustable at will, which enables the variations of inertia of the mast along its length to be controlled still more completely, the tongues 22A, 22B taking effect in the total inertia of the corresponding section of the mast.

According to the alternative form of construction shown in FIG. 7, the slot 13 of the mast according to the invention is also utilized for the mounting of a part 25 having longitudinally on the one hand a gutter 26 forming the dead sheave intended for the bolt-rope of the spread of sail 12, and on the other hand an extension 27 in the form of a T to ensure its retention in the slot 13.

In the case especially where the slot 13 of the mast according to the invention is edged with small tongues, the gutter 26 may be added on the mast along the edge of this latter opposite to this slot (see FIG. 8), by screwing, welding, riveting, or the like.

It will of course be understood that the present invention is not restricted to the forms of embodiment described and shown, but includes any alternative form of construction.

In particular, the invention is not limited to a mast obtained by shaping. It covers any mast with a slot over at least part of its height.

A mast of this kind may furthermore be obtained from a tube which is consequently slit.

It may also be obtained by any shaping operation other than folding, or by metal-working.

Shaping of this kind can result, as suggested in broken lines 30 in FIG. 2 in a mast having a base with a generally elliptic section with its major axis transverse with respect to the longitudinal plane of the sailing boat.

For a shaping operation of this kind, the initial sheet of metal is not necessarily trapezoidal.

In the case of the gutter forming the dead sheave intended for the bolt-rope of the spread of sail, this gutter may, according to the alternative form illustrated in broken lines 36 in FIG. 2, result in an omega-shaped piece fixed by its wings on the inner face of the lips 14A, 14B of the mast inside this latter; at the base of the mast, these lips are more widely spaced apart so as to permit the passage of the bolt-rope.

This fixing is preferably effected by screwing, and the gutter 36 is thus fixed to the mast only in that part of the mast where it is not necessary to give the latter the flexibility of torsion provided by the invention.

In practice, this flexibility of torsion is desirable at least at the base and at the head of the mast.

Furthermore, the fixing by screwing of this gutter along the mast is capable of being modified, by removal of screws or the placing in position of additional screws, and this modification results in a modification of the torsional flexibility of the mast at the corresponding points.

There is therefore a possibility of regulating the mast, especially in dependence of the weight of the steersman on the strength of the wind and on the state of the sea, which possibility exists furthermore on other alternative forms of embodiment of the invention, and especially that of FIG. 6.

An adjustment of this kind is advantageously immediate and can even be carried out during the course of navigation.

Thus, the gutter 36 serves at the same time for the regulation of the mast and the guiding of the bolt-rope.

Finally, it is self-evident that in all cases the invention is applied equally well to braced masts and to masts free of any bracing.

What I claim is:

1. A tubular mast for the rigging of a sailing boat, said mast being formed of sheet metal bent to a tubular shape with edges of the metal sheet generally defining a line of separation in said mast extending at least along portions of the height thereof, said line of separation extending in a longitudinal plane through said mast and facilitating torsional flexibility in said mast, said mast having a base and a head, fastening means securing together the edges of said metal sheet at selected spaced intervals only for controlling said torsional flexibility with said torsional flexibility being greater at said base and said head than in a central part of said mast, at least certain of said fastening means being of the readily removable and addable type facilitating a rapid change in said torsional flexibility.

2. The mast of claim 1 wherein said mast has a major axis transversely of said longitudinal plane.

3. The mast of claim 1 wherein said line of separation is defined by a pair of lips disposed in adjacent parallel relation on opposite sides of said longitudinal plane, and said fastening means extend between said lips.

4. The mast of claim 1 wherein said mast includes a base and a head and said mast tapers in section from said base to said head.

5. The mast of claim 1 wherein said mast carries generally in said central plane a vertically extending dead sheave for a sail bolt-rope.

6. The mast of claim 5 wherein said dead sheave is disposed immediately adjacent said line of separation and includes a pair of adjacent mounting flanges, and said fastening means directly interconnect said metal sheet edges and said mounting flanges.

7. The mast of claim 6 wherein said dead sheave is of an omega-shaped cross section and is disposed wholly within said mast.

8. The mast of claim 6 wherein said dead sheave includes a gutter portion disposed externally of said mast and a generally T-shaped mounting part having a portion extending into said mast through said line of separation.

9. The mast of claim 5 wherein said dead sheave is disposed remote from said line of separation.

* * * * *